United States Patent [19]

Bearint

[11] 4,434,982

[45] Mar. 6, 1984

[54] PUZZLE-GAME UTILIZING MOVABLE DISCS TO ATTAIN SPECIFIED ARRANGEMENT

[76] Inventor: Beryl I. Bearint, 802 No. Delaware St.-No. 406, San Mateo, Calif. 94401

[21] Appl. No.: 416,913

[22] Filed: Sep. 13, 1982

[51] Int. Cl.[3] ..... A63F 9/08

[52] U.S. Cl. ..... 273/153 S; 273/281

[58] Field of Search ..... 273/153 S, 281

[56] References Cited

U.S. PATENT DOCUMENTS

| | | | |
|---|---|---|---|
| 448,019 | 3/1891 | Garben | 273/153 S UX |
| 631,737 | 8/1900 | Compton et al. | 273/153 S |
| 642,374 | 1/1900 | Shaffer | 273/153 S |
| 690,664 | 1/1902 | Proctor | 273/153 S X |
| 897,089 | 8/1908 | Graves | 273/153 S |
| 1,257,205 | 2/1918 | Fallace | 273/153 S |
| 1,336,541 | 4/1920 | Shepherd | 273/153 S |
| 1,349,456 | 8/1920 | Hlasko | 273/153 S |
| 1,637,602 | 8/1928 | Chandler | 273/153 S |
| 2,564,502 | 8/1951 | Radford | 273/153 S UX |
| 3,148,884 | 9/1964 | Steinhardt | 273/153 S |

FOREIGN PATENT DOCUMENTS

| | | | |
|---|---|---|---|
| 199270 | 6/1923 | United Kingdom | 273/153 S |

*Primary Examiner*—Anton O. Oechsle

*Attorney, Agent, or Firm*—Alfons Puishes

[57] ABSTRACT

A game comprising a board having a series of connected slots arranged in relation to each other and provided with discs or buttons disposed for movement in the slots. The discs bear numbers and are initially arranged in a given order and then moved with respect to each other according to a definite set of rules so that they assume a specified sequential position with respect to each other which comprises the solution to the game. It may be played as solitaire or in competition.

7 Claims, 12 Drawing Figures

RANDOM SET-UP

| | | | | | | | | | | | |
|---|---|---|---|---|---|---|---|---|---|---|---|
| | SPOT# | 1 | 2 | 3 | 4 | | 5 | 6 | 7 | 8 | |
| | COLOR | G | R | Y | B | | G | Y | B | R | |
| 3 | SYMBOL | 3 | 3 | 3 | 3 | | 2 | 2 | 2 | 2 | 2 |
| | CODE # | | | | | F | | | | | |
| | SPOT# | 9 | 10 | 11 | 12 | I | | | | | |
| | COLOR | Y | B | G | R | | | | | | |
| 1 | SYMBOL | 1 | 1 | 1 | 1 | E | CRIB | | | | |
| | CODE # | | | | | L | | 1 | 2 | 5 | 4 | 3 |
| | SPOT# | 13 | 14 | 15 | 16 | | 17 | 18 | 19 | 20 | |
| | COLOR | G | Y | B | R | D | G | Y | R | B | |
| 5 | SYMBOL | 5 | 5 | 5 | 5 | | 4 | 4 | 4 | 4 | 4 |
| | CODE # | | | | | | | | | | |

| PLAYER | GAME | ROUND | CASTS | MOVES | SCORE |
|---|---|---|---|---|---|
| | | | | | |

R=RED G=GREEN Y=YELLOW B=BLUE

FIG. 6

PATTERN CONCLUSION

| | | | | | | | | | | | |
|---|---|---|---|---|---|---|---|---|---|---|---|
| | SPOT# | 1 | 2 | 3 | 4 | | 5 | 6 | 7 | 8 | |
| | COLOR | R | G | Y | B | | B | Y | G | R | |
| 3 | SYMBOL | 4 | 5 | 1 | 2 | | 1 | 5 | 4 | 3 | 2 |
| | CODE # | | | | | F | | | | | |
| | SPOT# | 9 | 10 | 11 | 12 | I | | | | | |
| | COLOR | R | G | Y | | | | | | | |
| 1 | SYMBOL | 2 | 3 | 4 | 5 | E | CRIB | | | | |
| | CODE # | | | | | L | | 1 | 2 | 5 | 4 | 3 |
| | SPOT# | 13 | 14 | 15 | 16 | | 17 | 18 | 19 | 20 | |
| | COLOR | R | G | Y | B | D | B | Y | G | R | |
| 5 | SYMBOL | 1 | 2 | 3 | 4 | | 3 | 2 | 1 | 5 | 4 |
| | CODE # | | | | | | | | | | |

| PLAYER | GAME | ROUND | CASTS | MOVES | SCORE |
|---|---|---|---|---|---|
| | | | | | |

R=RED G=GREEN Y=YELLOW B=BLUE

FIG. 7

PATTERN TO RANDOM SOLUTION

| | | | | | | | | | | | |
|---|---|---|---|---|---|---|---|---|---|---|---|
| 3 | SPOT # | 1 | 2 | 3 | 4 | | 5 | 6 | 7 | 8 | 2 |
| | COLOR | | | | | | | | | | |
| | SYMBOL | 4 | 5 | 1 | 2 | | 1 | 5 | 4 | 3 | |
| | CODE # | R | G | Y | B | F | B | Y | G | R | |
| 1 | SPOT # | 9 | 10 | 11 | 12 | I | | | | | |
| | COLOR | | | | | | | | | | |
| | SYMBOL | 2 | 3 | 4 | 5 | E | CRIB | 1 2 5 4 3 | | | |
| | CODE # | R | G | Y | B | L | | | | | |
| 5 | SPOT # | 13 | 14 | 15 | 16 | D | 17 | 18 | 19 | 20 | 4 |
| | COLOR | | | | | | | | | | |
| | SYMBOL | 1 | 2 | 3 | 4 | | 3 | 2 | 1 | 5 | |
| | CODE # | R | G | Y | B | | B | Y | G | R | |
| PLAYER | | GAME | ROUND | CASTS | | | MOVES | | | SCORE | |
| | | | | | | | | | | | |

R=RED G=GREEN Y=YELLOW B=BLUE

FIG. 8

PATTERN SOLUTION TO RANDOM SET-UP

| | | | | | | | | | | | |
|---|---|---|---|---|---|---|---|---|---|---|---|
| 3 | SPOT # | 1 | 2 | 3 | 4 | | 5 | 6 | 7 | 8 | 2 |
| | COLOR | Y | Y | R | B | | Y | G | B | G | |
| | SYMBOL | 4 | 5 | 1 | 2 | | 1 | 5 | 4 | 3 | |
| | CODE # | R | G | Y | B | F | B | Y | G | R | |
| 1 | SPOT # | 9 | 10 | 11 | 12 | I | | | | | |
| | COLOR | G | B | G | B | | | | | | |
| | SYMBOL | 2 | 3 | 4 | 5 | E | CRIB | 1 2 5 4 3 | | | |
| | CODE # | R | G | Y | B | L | | | | | |
| 5 | SPOT # | 13 | 14 | 15 | 16 | D | 17 | 18 | 19 | 20 | 4 |
| | COLOR | B | R | Y | R | | R | Y | G | R | |
| | SYMBOL | 1 | 2 | 3 | 4 | | 3 | 2 | 1 | 5 | |
| | CODE # | R | G | Y | B | | B | Y | G | R | |
| PLAYER | | GAME | ROUND | CASTS | | | MOVES | | | SCORE | |
| | | | | | | | | | | | |

R=RED G=GREEN Y=YELLOW B=BLUE

FIG. 9

NO PATTERN GOAL

SOLUTION TO RANDOM SET-UP & CODING

| | | | | | | | | | | | |
|---|---|---|---|---|---|---|---|---|---|---|---|
| 3 | SPOT # | 1 | 2 | 3 | 4 | | 5 | 6 | 7 | 8 | 2 |
| | COLOR | Y | Y | R | B | | Y | G | B | G | |
| | SYMBOL | 4 | 5 | 1 | 2 | | 1 | 5 | 4 | 3 | |
| | CODE # | R 18 | G 14 | Y 12 | B 7 | F | B 9 | Y 13 | G 20 | R 1 | |
| 1 | SPOT # | 9 | 10 | 11 | 12 | I | | | | | |
| | COLOR | G | B | G | B | | | | | | |
| | SYMBOL | 2 | 3 | 4 | 5 | E | CRIB | 1 2 5 4 3 | | | |
| | CODE # | R 5 | G 4 | Y 17 | B 15 | L | | | | | |
| 5 | SPOT # | 13 | 14 | 15 | 16 | | 17 | 18 | 19 | 20 | 4 |
| | COLOR | B | R | Y | R | D | R | Y | G | R | |
| | SYMBOL | 1 | 2 | 3 | 4 | | 3 | 2 | 1 | 5 | |
| | CODE # | R 10 | G 8 | Y 3 | B 19 | | B 2 | Y 6 | G 11 | R 16 | |

| PLAYER | GAME | ROUND | CASTS | MOVES | SCORE |
|---|---|---|---|---|---|
| | | | | | |

R=RED G=GREEN Y=YELLOW B=BLUE

FIG. 10

RESOLUTION OF CODE NUMBER TO COLOR & DISC. FOR ADJUSTMENT OF SET-UP

| | | | | | | | | | | | |
|---|---|---|---|---|---|---|---|---|---|---|---|
| 3 | SPOT # | 1 | 2 | 3 | 4 | | 5 | 6 | 7 | 8 | 2 |
| | COLOR | R | G | Y | B | | B | Y | G | R | |
| | SYMBOL | 4 | 5 | 1 | 2 | | 1 | 5 | 4 | 3 | |
| | CODE # | 18 | 14 | 12 | 7 | F | 9 | 13 | 20 | 1 | |
| 1 | SPOT # | 9 | 10 | 11 | 12 | I | | | | | |
| | COLOR | R | G | Y | B | | | | | | |
| | SYMBOL | 2 | 3 | 4 | 5 | E | CRIB | 1 2 5 4 3 | | | |
| | CODE # | 5 | 4 | 17 | 15 | L | | | | | |
| 5 | SPOT # | 13 | 14 | 15 | 16 | | 17 | 18 | 19 | 20 | 4 |
| | COLOR | R | G | Y | B | D | B | Y | G | R | |
| | SYMBOL | 1 | 2 | 3 | 4 | | 3 | 2 | 1 | 5 | |
| | CODE # | 10 | 8 | 3 | 19 | | 2 | 6 | 11 | 16 | |

| PLAYER | GAME | ROUND | CASTS | MOVES | SCORE |
|---|---|---|---|---|---|
| | | | | | |

R=RED G=GREEN Y=YELLOW B=BLUE

FIG. 11

PUZZLE-GAME UTILIZING MOVABLE DISCS TO ATTAIN SPECIFIED ARRANGEMENT

BACKGROUND OF THE INVENTION

Puzzles or games utilizing a board having slots or pads positioned upon it and equipped for movement of buttons, markers or discs in these slots in order to achieve different results and patterns are old in the art. They differ primarily in the patterns used for the slots and the method of moving of the discs in order to achieve different results and solutions.

Thus, U.S. Pat. No. 631,737 to Compton and Houck utilizes a board with the slots in the form of a triangle with one projecting end, the object being to move the discs within the slots so that those of similar colors and up together and those bearing stars appear at the vertices of the triangle.

U.S. Pat. No. 642,374 to Shaffer utilizes a board having a single horizontal slot connecting with two V-shaped slots. The buttons or discs bear letters and are moved with respect to each other along the horizontal slot with the aid of the connecting T-slots in order to spell out a given word along the horizontal slot.

U.S. Pat. No. 1,257,205 to Fallace utilizes slots in the form of a star and nine discs with a central circular slot connecting to the star shaped box. The nine discs are moved around the slots in the star elements and into the circular slot. The discs or buttons are colored red, white and blue and the object is to move all discs into the center circular slot in the order of red, white and blue representing the colors of the American flag.

U.S. Pat. No. 1,336,541 to Shepherd utilizes criss-crossing slots and numbered discs from one to twelve. The discs are moved so that the sum total of the numbers in each individual slot, numbering four, total up to twenty-six.

U.S. Pat. No. 1,349,456 to Hlasko utilizes a T-shaped slot with methods of controlling the movement of the different sized movable elements or discs, the object being to arrange the buttons or discs in a predetermined numerical order with respect to each other.

U.S. Pat. No. 1,637,602 to Chandler uses a horizontal slot with a series of pockets connecting thereto. The object is to move the discs, each of which bears a letter, along the horizontal slot and in and out of the pockets to arrange them in an order which spells out a given word after they all have been placed in an individual slot.

U.S. Pat. No. 3,148,884 to Steinhardt utilizes a series of intersecting slots of different lengths. The discs which slide in the slots are numbered and must be arranged so that finally they are in numerical sequence.

In most of the prior art the movable discs are spool shaped with a narrow center section and two cylindrical outer sections which hold the discs in the slots on the board and prevent their falling out during the progress of the game. Most of the puzzles are relatively simple and do not require a great deal of concentration for their solution.

SUMMARY OF THE INVENTION

I have invented a game board which also utilizes a plurality of slots in which are arranged the discs for relative movement. The slots are arranged in the shape of a Vee or chevron with six slots, each connecting at the point of the Vee with a central slot which joins to a Y-shaped slot utilized for holding certain of the discs in a homing position. Only five of the slots have discs in them, the sixth slot being used as a by-pass or side track in effecting the movements of the discs between slots. The similar discs are initially arranged in their respective indexed slots which are numbered from 1 to 5. The sets of discs numbered consecutively 1 through 5 bear one of five different colors, namely, red, green, yellow and blue and black. The object of the game is to rearrange the discs so they would appear in the slots in numerical sequence in no more than twenty-seven moves, it being permissible to move more than one disc at a time. The solution of the puzzle is facilitated by the use of printed cards known as "DisCards".

DESCRIPTION OF THE FIGURES

FIG. 6 is a printed card or "DisCard" showing in grid form an initial set-up arrangement of the discs at the start of the game with colors at random.

FIG. 7 is a printed card or "DisCard" in grid form showing the arrangement of the discs to be attained upon final solution of the puzzle.

FIG. 8 is a printed card or "DisCard" showing in grid form notation of the pattern arrangement and preparation for the acceptance of the solution obtained from the random set-up of FIG. 6.

FIG. 9 is a printed card or "DisCard" showing in grid form the arrangement or solution obtained from the random set-up of FIG. 6.

FIG. 10 is a printed card of "DisCard: showing in grid form the arrangement or solution obtained from the random set-up of FIG. 6, including applicable "code" numbers to each disc position with the different "code" numbers occasioned by the solution and are a key to final conclusion of the puzzle.

FIG. 11 is a printed card or "DisCard: showing in grid form the resolution of code number to color and symbols discs as included in FIG. 10 for adjustment of set-up.

DESCRIPTION OF A PREFERRED EMBODIMENT

Figure 1:
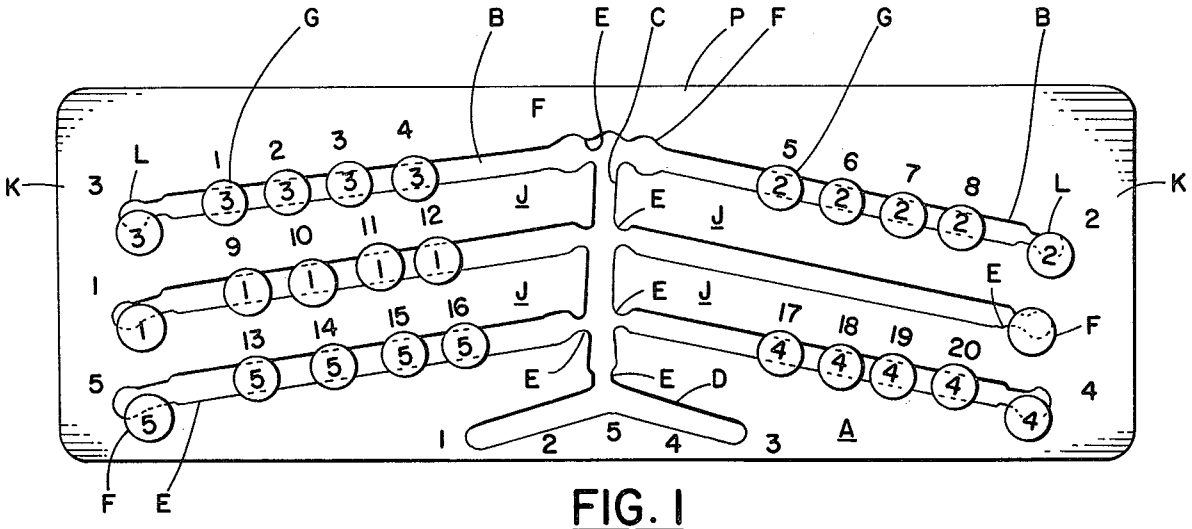
FIG. 1 is a plan view of the board of my puzzle-game showing the movable discs in position at the start of a game.
Figure 2:
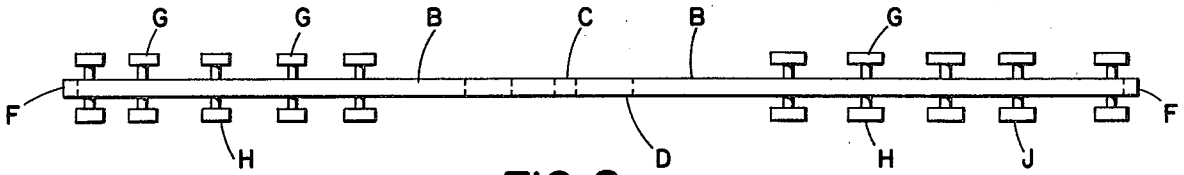
FIG. 2 is a side end view of my board showing the discs in the same position.

My invention of a puzzle-game known as Disctrix is best understood by reference to FIG. 1 in which there is seen a board A which may be of plastic, metal, wood or any other suitable material and a plurality of movable discs or buttons G. The board A is a thin elongated rectangular plate through which are cut the channels or slots B diagonally parallel and equidistant from each other across the length of the plate. As seen in the diagram, the slots are disposed to present a chevron shaped configuration joined at their vertices by a space that comprises a further slot down through the center vertically denoted as conduit C. The slots B in the vicinity of their terminals include notches F and spurs E. The slots B terminate at the center and a further slot or conduit C, which is vertically disposed on the board, and at this point the slots B also have within them notches F and spurs E designed to impede the progress of the discs G through the slots B. Conduit C at its lower extremity is connected into a Y-shaped slot known as the crib D whose function will appear in a later description.

Figure 3:
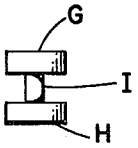
FIG. 3 is an elevation of one of my discs showing its construction.
Figure 5:
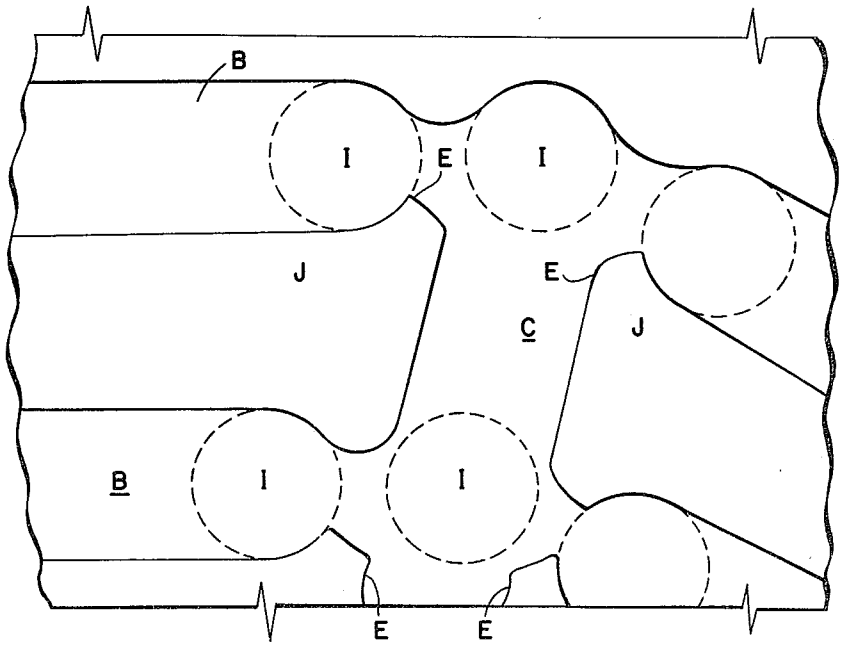
FIG. 5 is an enlarged view of the central portion of the slots showing the spurs and notches which form a part of the slot where it joins the central conduit.

The spurs E are proportioned to impede the passage of the discs G having intermediate shaft I and lower sections H as best seen on FIG. 3. It is evident that additional pressure will be required to move the discs G through the spurs. This characteristic serves to capture, confine and control the discs G in the slots B, notches F and crib D. The conduit C divides the V-shaped slots B into six smaller slots in diagonal parallel relationship, three to the right and three to the left of the conduit C, which results in the formation of narrow, flat blades J that project toward the center of each other from the index panels K at either end of the plate, numbered 1 through 5. The conduit C is continued below the slots passing through the crib D previously described and comprises the lower section of the board A.

Figure 4:
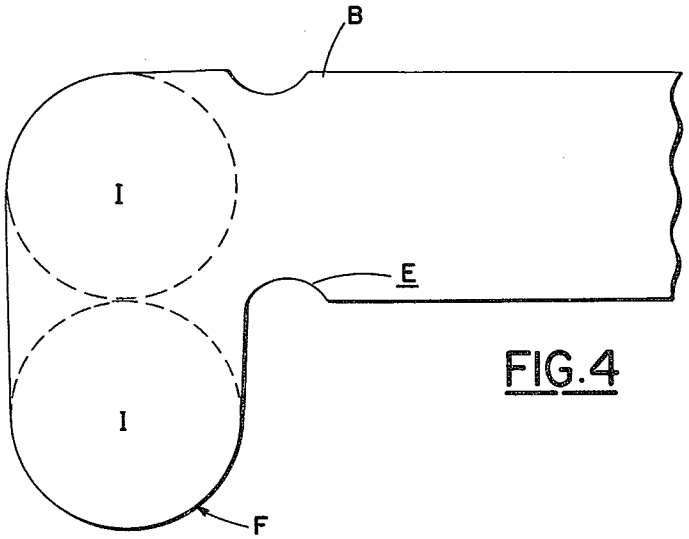
FIG. 4 is an enlarged view of the outer end of the slots showing the notches and spurs which form a part of the slot at this point.

At the opposite ends of the board A are situated the index panels K wherein are located the notches F of the slots B, best seen on FIG. 4.

On the index panels K, the notches F are marked with the numbers of the slots which are reading left to right and downward 3—upper left slot; 2—right upper slot; 1—left middle slot; 5—left lower slot; and—4—right lower slot. The one channel at the middle right is an auxillary and is unmarked. It is utilized in shunting discs to facilitate their movement from slot to slot. The slots are marked above and alongside each slot indicating the spot positions from the notch F. These are spaced apart a distance of one disc and are read left to right and downward beginning with slot 3—1 to 4, slot 2—5 to 8, slot 1—9 to 12, slot 5 with 13 to 16 and ending with slot 4—17 to 20. The spots in the crib are left to right 1, 2, 5, 4, 3 and discs must be placed in crib in numbered sequence beginning with 1 and cannot be changed during a game.

The discs G are formed of two small, solid wheels G and H joined in their centers by a short shaft I to create a small spool shaped reel which provides the apparatus for the containment and mobility in the slots B of the Board as best seen on FIG. 3. On the top surface of the wheels are borne the numbers of each disc, which are of different colors as indicated. The discs are 25 in number divided into five sets of five different numbers, one through 5, however, any desirable arrangement of different but related symbols may be used. Each set of numbers is the same but are of five different colors, namely, red, green, yellow, blue and black which insures that each disc is distinguishable from all others which is an important factor in the game.

Of the five sets of discs, one may function as the index discs, which at set-up occupy the notches of their respective slots and at conclusion are in their similarly marked positions in the crib. These discs must enter the crib in 1, 2, 3, 4, 5 order, only. They do not enter into the game play, per se but rather come involved only as they are exposed in their slots as a result of manipulation of the active discs. They serve to monitor the progress of the game moving from notch to crib, only and are colored black.

Referring now to FIGS. 6 through 12, there are shown drawings of the "DisCards" mentioned above, each one of which performs a separate function as will now be explained.

FIG. 6 represents what I call my random set-up which indicates the position of the discs as given to the player at the start of the game. It is noted that the discs are placed according to number in slots B, the numbers corresponding to the numbers of the index panels shown on FIG. 1. The colors green, red, yellow and blue are indicated but there is no attempt at this point to place them in any particular order. Consequently this is why this is called a "random" set-up.

Referring now to FIG. 7, there is shown the position of the discs in the final form conclusion-pattern including the proper color location, the discs being in numberical sequence with the index numbers shown at the ends. This result or solution is not obtained in the first go-around of the game from random but instead after playing the game through once we obtain an arrangement shown in FIG. 9 which is a solution based on the random set-up of FIG. 6 and which I term a solution.

At this point a further explanation of the game board and "DisCards" is needed to clarify the game as later played. Each spot position carries its number.

Referring to FIG. 8 there is displayed the grids of the "Dis-Card" prepared by reflecting the required pattern for color, in participation of recording the resulting colors of the solution as is demonstrated in FIG. 9.

FIG. 9 shows the color data recorded for each disc that results from that which is given and that which is obtained from the solution. The comparison of this color data from each disc leads to "discovery" for any correction in the set-up. The spot positioning of a color disc in the set-up is the code number it contributes to the solution, FIG. 6 at the spot position it occupies in the solution.

FIG. 10 shows all the data pertinent to each disc; color of disc at random solution, pattern color required and code number of each of the latter two translate into the position correction required for the disc in the set-up.

FIG. 11 simplifies the data gleaned up to FIG. 10 and presents the data on the grid as a key indicating for each disc the color and spot position in the set-up and adjustment to insure the conclusion.

Figure 12:
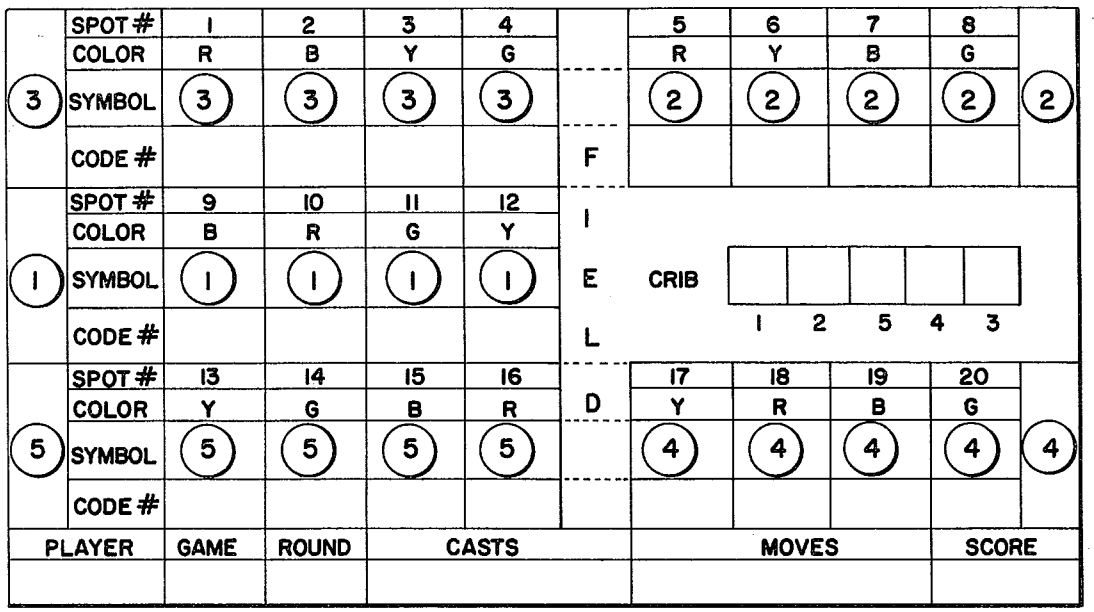
FIG. 12 is a printed card or "DisCard" showing in grid form the adjusted set-up required for and leading to the final solution or conclusion.

FIG. 12 shows the set-up indicated by the data supplied from FIG. 11.

Each spot position carries its number. For the pattern card these would be arranged in sequence, for the set-up card the numbers would be matching. The code number spaces are used to provide the link for planning a corresponding relationship between the goal and set-up positions of the discs as an aid toward the solution. Whether sequence or matching, the discs identify with the index as indicated. An appropriate number of spaces are allotted for recording data for games in competition.

The index K represents the numbers that mark the notches of the slots situated on the index panels at either end of the board. Here the relationship of the discs and slots is established controlling the order, rotation and manner in which the discs may be placed, moved or collected. The point of reference in controlling the direction of play is in the index. All readings of the discs in the slots progress this location in the index panels whether it be to the left or right. Therefore, discs in spot positions are in the slots originating on the left are read left to right; those on the right are read right to left. (See for example FIG. 8.) Thus, slot 3 would be read 3—4, 5, 1, 2 and slot 4 would be read 4—5, 1, 2, 3.

The spot positions do not reflect the sequence of the discs. This is reserved wholly to the numbers of the discs. The spot positions are for identification of placement.

My disctrix puzzle-game may be considered as having four phases. 1.—set-up; 2.—solution; 3.—discovery and 4.—conclusion.

The set-up is the arrangement of the discs from which the basic procedure of solution is initiated. This is given and has all similar discs in their respective slots as shown. The spot positioning is the first precedure that finalizes the set-up for a purposeful arranging of the discs in the spots according to their color within their respective slots. The basic procedure of solution is the heart of the game and involves the manipulation of the discs in units or stacks as defined below, according to the rules of play, and achieving the goal or pattern in twenty-seven moves. The goal or conclusion is the condition when the discs are displayed upon the board, four discs per slot, the crib secured, the numbers in proper sequence, and colors in the prescribed pattern constituting conclusion or final solution of the puzzle. The arrangement desired is given at the beginning of the game as shown on FIG. 7.

Regarding the rules of play, the discs may be moved in "units" or "stacks" only and when these entities can be mated and placed directly adjacent to active "host" discs which must match or be in sequence to a "donor" disc, or in a vacant slot with which they are combined. Index discs L serve to be collected in the crib as they are released correctly during play. A "unit" is either one disc or two dissimilar adjacent discs that are moved. A "stack" is two to four adjacent similar discs that are moved. The sensitive discs involved in a move are the active discs and, in all instances of the number of discs involved in a move, it is the disc nearest the notch or the index panel or the exposed uppermost disc in the slot, when "host", prior to a move. The "donor slot" provides an active "donor disc" that is transferred as a "unit" or "stack". The "host" slot provides the active "host" disc with which the active "donor" disc is combined when transferred to the "host" slot. No more than seven discs, the index disc excluded, may be in any slot at any time. The relationship of the discs to each other in a move may not be changed.

When the solution to the random set-up, as shown on FIG. 11, is attained it is necessary to rearrange the set-up in order to attain the final goal shown on FIG. 7 with regard to color as well as sequence.

In order to do this a new set-up must be made as shown in FIG. 12 by rearranging the discs to start the game over again. The rules or guides for rearranging the discs are as follows:

Within the construction of the Disctrix device, its rules and basic procedures for solution rigidly applied to its function, there exists a constant (K) relationship between the set-up and goal spot positions for the discs. Due to the constancy, the game may proceed from solution to conclusion.

Solution is the achievement of the required distribution of the discs in sequence (symbols, numbers, figures, etc.)

Conclusion is the achievement of the required distribution of the discs in both sequence and color.

Because of the constancy relating the spot positions of the discs vis-a-vis their set-up to goal (sequence, solution, Pattern, conclusion), it becomes quite evident that when at goal a disc of another color occupies the spot position of a required color disc for the pattern, the indication is that the required color disc should have occupied the spot position in the set-up of the improper color disc. A disc from set-up transfers the number of its spot position to the relative placement in the solution as code number. When my pattern requires that a color disc occupy a specific spot positioned in the solution, that specific color disc must accordingly assume the code number of the desired spot position and thereby be directed to the numbered spot position in the set-up. This identification leads to discovery and through this method a code evolves after all spot positions have been inspected and compared for correction.

Having achieved solution (sequence) to the set-up recorded on the set-up discard (FIG. 6), the resulting colors of the discs are recorded in the spaces marked for color on the pattern discard (FIG. 8) where previously has been inserted in the spaces for code numbers, the colors of the required pattern (FIG. 7). If the colors in the color and code number spaces of the symbol block (all space given to a symbol) is not the same, then the set-up is faulty. This error is corrected by discovery, in which the faulty color disc is identified in its spot position in the set-up (FIG. 6) and this spot position assigned to the required color disc and recorded on the pattern discard as the code number in the code number space next to the noted color (FIG. 10). Hence, the data in the code number space of the block on the pattern discard directs the correct disc placement for spot position and color in the set-up to which this data refers. Applying this method to the solution, the discs may be adjusted as in FIG. 12 and the game replayed to conclusion.

Based on functional proof provided by the process of solution and discovery, the colored discs identified at their spot positions in the set-up are observed to be distributed in the conclusion, always, to precise spot positions for the pattern. This relationship can be codified and established into a table that when applied to any pattern proposed will provide the correct data for the set-up and a game then can be played from set-up to conclusion without necessity of solution and discovery.

TABLE

| | DISCTRIX SPOT POSITIONS | |
|---|---|---|
| DISC Symbols 1 @ of 4 colors | AT: Pattern, Solution, Goal Sequence or Conclusion | AT: SET-UP |
| 4 | 1 | 18 |
| 5 | 2 | 14 |
| 1 | 3 | 12 |
| 2 | 4 | 7 |
| 1 | 5 | 9 |
| 5 | 6 | 13 |
| 4 | 7 | 20 |
| 3 | 8 | 1 |
| 2 | 9 | 5 |
| 3 | 10 | 4 |
| 4 | 11 | 17 |
| 5 | 12 | 15 |
| 1 | 19 | 10 |
| 2 | 14 | 8 |
| 3 | 15 | 3 |
| 4 | 16 | 19 |
| 3 | 17 | 2 |
| 2 | 18 | 6 |
| 1 | 19 | 11 |
| 5 | 20 | 16 |

TABLE-continued

| DISC | DISCTRIX SPOT POSITIONS AT: | |
|---|---|---|
| Symbols 1 @ of 4 colors | Pattern, Solution, Goal Sequence or Conclusion | AT: SET-UP |

This Table is applied as in FIG. 10 with results as in FIG. 9

The discs are again moved according to the foregoing rules by matching or sequence, continuing until the sequence is obtained as before but in this case the goal will be as shown on FIG. 10 which corresponds to the original required goal of FIG. 8 insofar as color as well as sequence is concerned.

Symbols identified by a definite sequence instead of numbers may be used for this game.

I claim:

1. A puzzle-game comprising a flat board;

first and second pluralities of parallel slots through said board;

a first end of each of said parallel slots terminating in a closed end in said board;

second ends of said slots terminating in a central common connecting slot positioned across said parallel slots;

a plurality of movable spool-shaped discs having cylindrical ends joined by smaller cylindrical connecting members;

said connecting members being disposed to move in said slots;

said cylindrical ends being larger in diameter than the width of said slots;

one of the cylinders of each of said discs being of one of five different colors and having numbers 1 to 5 imprinted thereon;

said central connecting slot terminating in a Y-shaped slot termed a crib closed at its ends;

said parallel slots having an enlarged section at each end to accommodate said connecting members of said discs and a restricted section adjacent thereto to impede the motion of said discs in said slots;

whereby starting from a predetermined relative position of said discs in said slots a specified arrangement of said discs may be attained in a given number of moves.

2. The puzzle-game of claim 1 in which the parallel slots are six in number; the discs are twenty-five in sets of five in number and each set of five discs are of a different color and being numbered 1 to 5 to correspond to numbers identifying the said slots and the number of moves is twenty-seven.

3. The puzzle-game of claim 2 in which one set of said discs is positioned at the closed end of each of said parallel slots, each disc of said set bears a number corresponding to the number identifying the slot in which it is positioned and at the conclusion of said game appears in said crib.

4. The puzzle game of claim 3 in which the discs are moved singly, in pairs of two dissimilar numbers or in groups of two to four adjacent similar discs, no more than seven discs appearing in a single parallel slot not counting selected ones of said slots identified as ends of said parallel slots.

5. The puzzle-game of claim 3 in which the discs finally appear in said crib in sequence and in a predetermined color order.

6. A puzzle-game comprising a flat board;

first and second pluralities of parallel slots through said board;

a first end of each of said parallel slots terminating in a closed end in said board;

second ends of said slots terminating in a central common connecting slot positioned across said parallel slots;

a plurality of movable spool-shaped discs having cylindrical ends joined by smaller cylindrical connecting members;

said connecting members being disposed to move in said slots;

said cylindrical ends being larger in diameter than the width of said slots;

one of the cylinders of each of said discs being of one of five different colors and having distinguishable symbols having an established sequence imprinted thereon;

said central connecting slot terminating in a Y-shaped slot termed a crib closed at its ends;

said parallel slots having an enlarged section at each end to accommodate said connecting members of said discs and a restricted section adjacent thereto to impede the motion of said discs in said slots;

whereby starting from a predetermined relative position of said discs in said slots a specified arrangement of said discs may be attained in a given number of moves.

7. The puzzle-game of claim 6 in which said slots are identified by different symbols having an established sequence.

* * * * *